US006003352A

United States Patent [19]

Yu

[11] Patent Number: 6,003,352

[45] Date of Patent: Dec. 21, 1999

[54] KEY RING ASSEMBLY

[76] Inventor: San-Chih Yu, No. 73-17, Sec. 2, Chung Hsing Rd., Ta Li City, Taichung Hsien, Taiwan

[21] Appl. No.: 09/239,162

[22] Filed: Jan. 28, 1999

[51] Int. Cl.[6] ..... A47G 29/10

[52] U.S. Cl. ..... 70/459; 70/456 R; 24/599.8

[58] Field of Search ..... 70/456 R, 459, 70/457, 458; 24/116 A, 599.8, 3.6, 644, 701; 206/37.1, 38.1, 37.5, 37.6, 37.7, 37.8

[56] References Cited

U.S. PATENT DOCUMENTS

| | | | |
|---|---|---|---|
| 926,156 | 6/1909 | Waterhouse | 70/459 |
| 3,126,603 | 3/1964 | Cedarstaff | 70/459 |
| 4,741,434 | 5/1988 | Liebman | 70/456 R |
| 5,168,735 | 12/1992 | Wang | 70/457 |
| 5,398,389 | 3/1995 | Terada et al. | 24/599.8 |
| 5,495,734 | 3/1996 | Yu | 70/459 |
| 5,586,374 | 12/1996 | Nishida | 24/599.8 |

*Primary Examiner*—Darnell M. Boucher
*Attorney, Agent, or Firm*—Thorp Reed & Armstrong

[57] ABSTRACT

A key ring assembly includes first and second half bodies which are coupled together, a pivot member pivotably received between the first and second half bodies and having a retainer movably received therein, a biasing member having a first pressing end abutting against the retaining arm and a second pressing end adjustably engaged with an arcuate rib formed on the first half body. With such an arrangement, the retainer extends through a channel in the pivot member and a trough in the arcuate rib and selectively extends into a sliding groove between the first and second half bodies, so that key fasteners are able to be confined in the sliding groove and freely leave the confinement of the key ring assembly only when desired.

4 Claims, 5 Drawing Sheets

KEY RING ASSEMBLY

BACKGROUND OF THE INVENTION

1. Field of the Invention

The present invention relates to a key ring assembly, and more particularly to a key ring assembly having a retainer slidably received therein to effectively stop key fasteners from disengagement with the key ring assembly.

2. Description of Related Art

A conventional key ring assembly is disclosed in U.S. Pat. No. 5,496,734 and shown in FIGS. 5 and 6. Such a constructed key ring assembly mainly comprises a first half body (90), a second half body (91) coupled with the first half body (90) and a pivot member (93) pivotally received between the first half body (90) and the second half body (91). The first half body (90) having a first flange portion (92) which is laterally formed along a periphery thereof and projects outwardly therefrom and comprises a first distal end (921) and a second distal end (922), a hook member (94) comprising a first end portion (941) located above the first distal end (921) of the first flange portion (92) and a second end portion (942) integrally formed with the second distal end (922) of the first flange portion (92), a first opening (923) defined between the first distal end (921) of the first flange portion (92) and the second end portion (942) of the hook member (94), a first recess (98) defined in a face of the first half body (90) and a spindle (981) extending out from a surface of the first recess (98). The second half body (91) is coupled to the first half body (90) and comprises a second flange portion (93) laterally formed along a periphery thereof and projecting therefrom facing towards the first flange portion (92) and comprising a first free end (931) in alignment with the first distal end (921) of the first flange portion (92) and a second free end (932), a sliding groove (97) (see FIG. 6) defined between the first and second flange portions (92, 93), a second opening (933) defined between the first and second free ends (931, 932) of the second flange portion (93) and communicating with the first opening (96), a second recess (95) defined in a face of the second half body (91) and aligning with the first recess (98) and a through hole (951) defined in a surface defining the second recess (95).

The substantially C-shaped pivot member (99) is pivotally mounted between the first and second half bodies (90, 91) and has a retaining arm (991) integrally formed on the pivot member (99) and abutting against the first distal end (921) of the first flange portion (92) and the first free end (931) of the second flange portion (93) and in alignment with the first end portion (941) of the hook member (94) so as to form a loop, the retaining arm (991) being able to pivot with the pivot member (99) to slide between the first and second openings (923, 933). A biasing member (96) is mounted between the first and second half bodies (90,91) and comprises a first pressing end (961) abutting against the retaining arm (991) and a second pressing end (962) abutting against the second end portion (942) of the hook member (94).

Preferably, the first recess (98) and the second recess (95) respectively defined in the first and second half bodies (90,91) are respectively flush with the pivot member (99) for retaining the pivot member (99) in place. In addition, the pivot member (99) has a compartment (992) transversely defined therethrough for receiving the biasing member (96) therein. A cutout (993) is further defined in the pivot member (99) beside the retaining arm (991) and communicating with the compartment (992) for receiving the first and second pressing ends (961, 962) of the biasing member (96) therein. The spindle (981) of the first half body (90) is formed on a mediate portion thereof and extends through the compartment (992) and the through hole (951) so as to couple the first and second half bodies (90,91) together by means of such as rivet fitting arrangement.

However, by such an arrangement, there are still some shortcomings in the conventional key ring assembly of the type described above.

As known, the key ring assembly shown in FIG. 5 retains a key fastener (50) slidably received in the sliding groove (97) between the first half body (90) and the second half body (91) mainly by the abutting force of the biasing member (96) to the retaining arm (991). When the key fastener (50) is heavily loaded, the abutting force of the biasing member (96) will not be able to overcome the weight of the key fastener (50), so that keys (not numbered) suspended on the key fastener (50) are easily lost from this type of key ring assembly because of the load of the keys pushing away the retaining arm (991).

The present invention has arisen to mitigate and/or obviate the above-mentioned disadvantages of the conventional key ring assembly.

SUMMARY OF THE INVENTION

The primary objective of the present invention is to provide a key ring assembly which is able to prevent the retaining arm from disengaging from the hook member so that keys retained in the key ring assembly are securely attached to the assembly. In accordance with one aspect of the present invention, there is provided a key ring assembly comprising a first half body having a first flange portion which is laterally formed along the periphery thereof and projects outwardly therefrom and comprises a first distal end and a second distal end, a hook member having a first end portion located above the first distal end of the first flange portion and a second end portion formed on the second distal end of the first flange portion, a first opening defined between the first distal end of the first flange portion and the second end portion of the hook member, an arcuate rib integrally formed with and extending out from the second end portion of the hook member and having a plurality of grooves defined in one distal end thereof, a trough defined in the other distal end thereof and a plurality of equally spaced apart pins formed on the arcuate rib, a second half body coupled to the first half body in a rivet fitting engagement and having a second flange portion which is laterally formed along a periphery thereof and projects therefrom facing towards the first flange portion and comprises a first free end and a second free end, a sliding groove defined between the first and second flange portions, a second opening defined between the first and second free ends of the second flange portion and communicating with the first opening, and a plurality of holes each defined to correspond to one of the plurality of pins, a pivot member pivotally mounted between the first and second half bodies, a retaining arm formed on the pivot member and abutting against the first distal end of the first flange portion and the second end portion of the hook member and in alignment with the first end portion of the hook member to form a loop, the retaining arm being able to pivot with the pivot member to slide in the first and second openings and having a recess and a sectorial channel defined therein, a biasing member mounted in the recess of the pivot member and comprising a first pressing end abutting against the retaining arm and a second pressing end extending out from the recess and received in one of the grooves in the arcuate rib and a retainer movably received in the sectorial channel.

Further objectives and advantages of the present invention will become apparent from a careful reading of the detailed description provided hereinafter, with appropriate reference to the accompanying drawings.

DETAILED DESCRIPTION OF THE PREFERRED EMBODIMENTS

Figure 1:
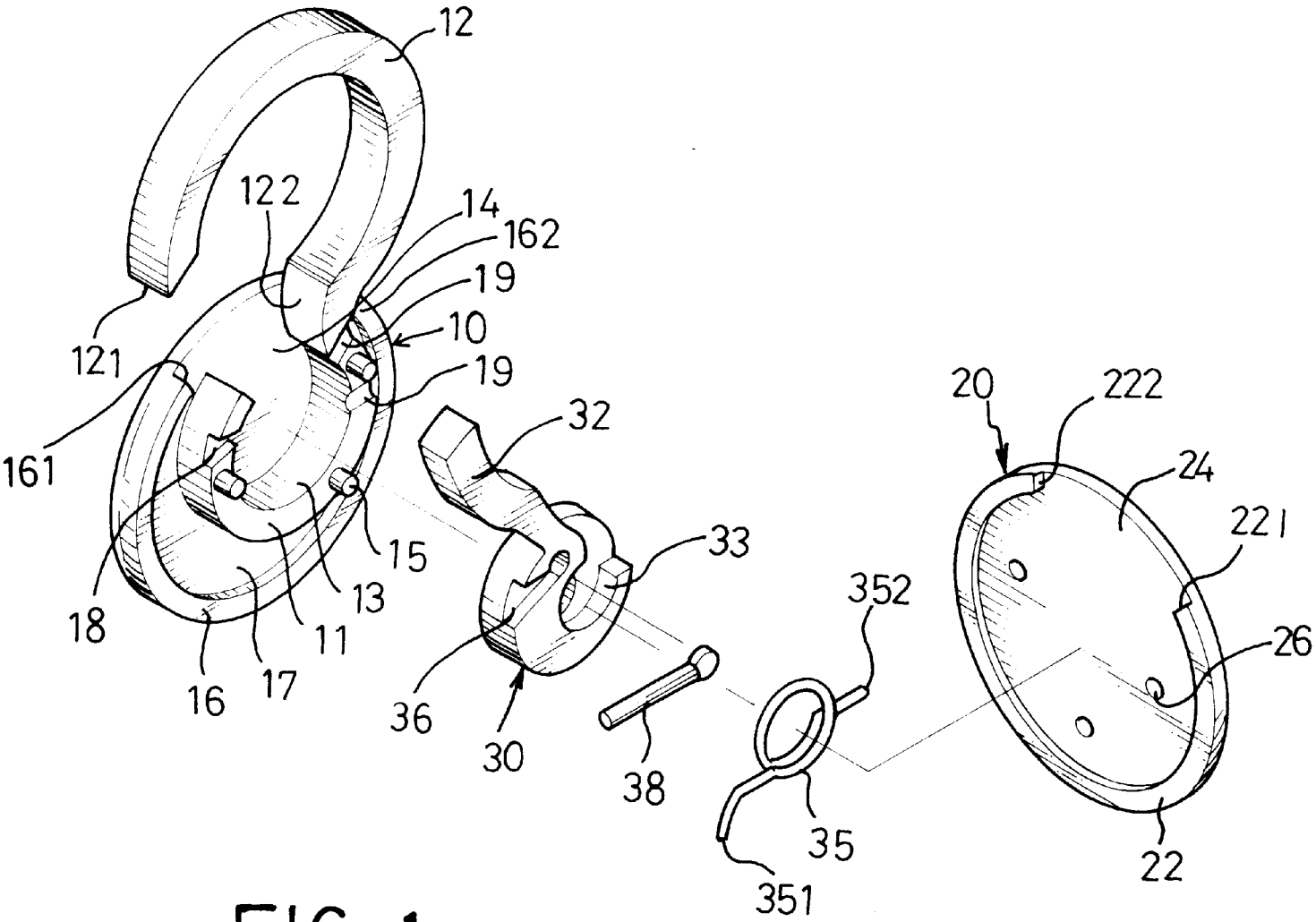
FIG. 1 is an exploded perspective view of a key ring assembly in accordance with the present invention.

Referring to FIG. 1, a key ring assembly in accordance with the present invention comprises:

a first half body (10) having a first flange portion (16) which is laterally formed along the periphery thereof and projects outwardly therefrom and comprises a first distal end (161) and a second distal end (162), a hook member (12) having a first end portion (121) located above the first distal end (161) of the first flange portion (16) and a second end portion (122) formed on the second distal end (162) of the first flange portion (16), a first opening (14) defined between the first distal end (161) of the first flange portion (16) and the second end portion (122) of the hook member (12), an arcuate rib (11) integrally formed with and extending out from the second end portion (122) of the hook member (12) and having a plurality of grooves (19) defined in one distal end thereof, a trough (18) defined in the other distal end thereof and a plurality of equally spaced apart pins (15) formed on the arcuate rib (11);

a second half body (20) coupled to the first half body (10) by a riveted attachment and having a second flange portion (22) which is laterally formed along the periphery thereof and projects therefrom facing towards the first flange portion (16) and comprises a first free end (221) and a second free end (222), a sliding groove (17) defined between the first and second flange portions (10, 20), a second opening (24) defined between the first and second free ends (221, 222) of the second flange portion (22) and communicating with the first opening (14), and a plurality of holes (26) each defined to correspond to one of the plurality of pins (15) of the first half body (10);

a pivot member (30) pivotally mounted between the first and second half bodies (10, 20) and having a retaining arm (32) formed on the pivot member (30) and abutting against the first distal end (161) of the first flange portion (16) and the second end portion (122) of the hook member (12) and in alignment with the first end portion (121) of the hook member (12) to form a loop, the retaining arm (32) being able to pivot with the pivot member (30) to slide in the first and second openings (14, 24) and having a recess (33) and a sectorial channel (36) defined therein; and a biasing member (35) mounted in the recess (33) of the pivot member (30) and comprising a first pressing end (351) abutting against the retaining arm (32) and a second pressing end (352) extending out from the recess (33) and received in one of the grooves (19) in the arcuate rib (11) and a retainer (38) securely and movably received in the sectorial channel (36).

In assembly, the pivot member (30) with the biasing member (35) received in the recess (33) and the first pressing end (351) thereof abutting against the retaining arm (32) is placed in a compartment (13) defined by the arcuate rib (11), whereas the second pressing end (352) of the biasing member (35) extends out from the recess (33) and is received in one of the grooves (19) thereby allowing the biasing member (35) to adjust its recovering force as required. Furthermore, the retainer (38) is securely and movably received in the sectorial channel (36), and a distal free end thereof extends through the trough (18) of the arcuate rib (11) and into the sliding groove (17) when the retainer (38) rests on a face defining the sectorial channel (36). After the pivot member (30) is in place in the compartment (13), the retaining arm (32) aligns with the first end portion (121) of the hook member (12) to form a hook. Thereafter, the second half body (20) engages with the first half body (10) by the plurality of pins (15) inserted into the corresponding holes (26) and connecting with each other like rivets.

Figure 2:
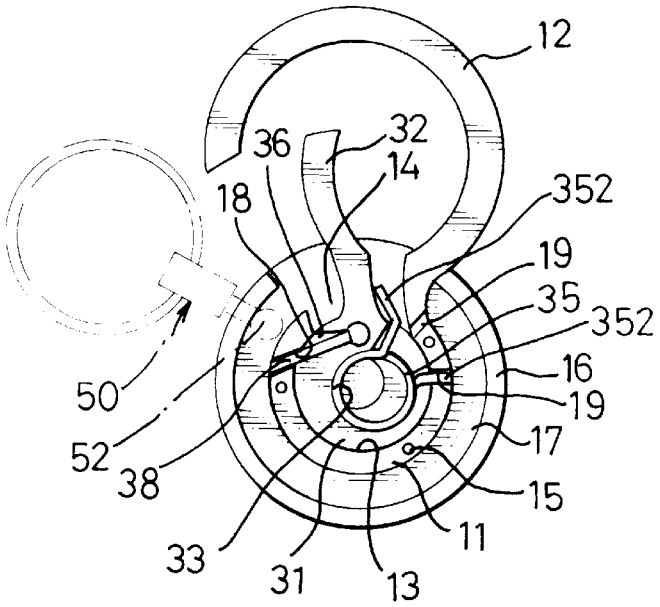
FIG. 2 is a schematic view showing the operation of the biasing member resulting in that the retainer is entirely received in the sectorial channel to allow a fastener to leave the confinement of the loop consisting of the retaining arm and the hook member.
Figure 3:
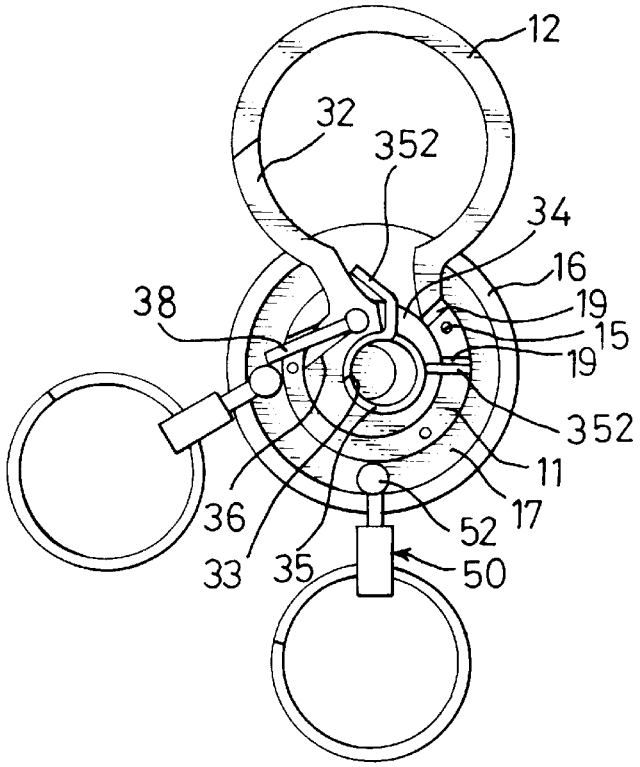
FIG. 3 is a schematic view showing that when the biasing member abuts against the retaining arm, the protrusion of the retainer will prevent the fastener from leaving the confinement of the loop.

Referring to FIGS. 2 and 3, when the first half and the second half bodies (10, 20) are securely connected together, and the biasing member (35) as well as the retainer (38) are in position in the recess (33) and the sectorial channel (36) respectively, the retainer (38) extends through the trough (18) and into the sliding groove (17). Because the retainer (38) extends into the sliding groove (17) between the first half and the second half bodies (10, 20) and is confined by the trough (18), a key fastener (50) with a ball like stop (52) is slidably confined in the sliding groove (17) and blocked by the protrusion of the retainer (38). As a result, the key fastener (50) is prevented from leaving the key ring assembly of the invention. However, when pushing the retaining arm (32) of the pivot member (30) towards the second end portion (122) of the hook member (12), the pivot of the retaining arm (32) will lead the retainer (38) to pivot as well. Meanwhile, as a result of the pivot of the retaining arm (32), the sectorial channel (36) provides a tolerance to the retainer (38), such that the retainer (38) retracts back in the trough (18), thereby allowing the key fastener (50) to freely leave the confinement of the loop from the sliding groove (17).

It is to be noted from FIGS. 2 and 3 that when the retaining arm (32) is not pressed towards the second end portion (122) of the hook member (12), the retainer (38) is confined by the trough (18), so that the stop (52) of the key fastener (50) is stopped by the retainer (38) in the sliding groove (17), whereas the retaining arm (32) is pressed towards the second end portion (122), the retainer (38) pivots along the retaining arm (32), which retracts the protruding portion of the retainer (38) to free the sliding groove (17). As a result of the retraction of the retainer (38), the stop (52) is able to leave the key ring assembly of the invention from the corresponding first and second openings (14, 24).

Figure 4:
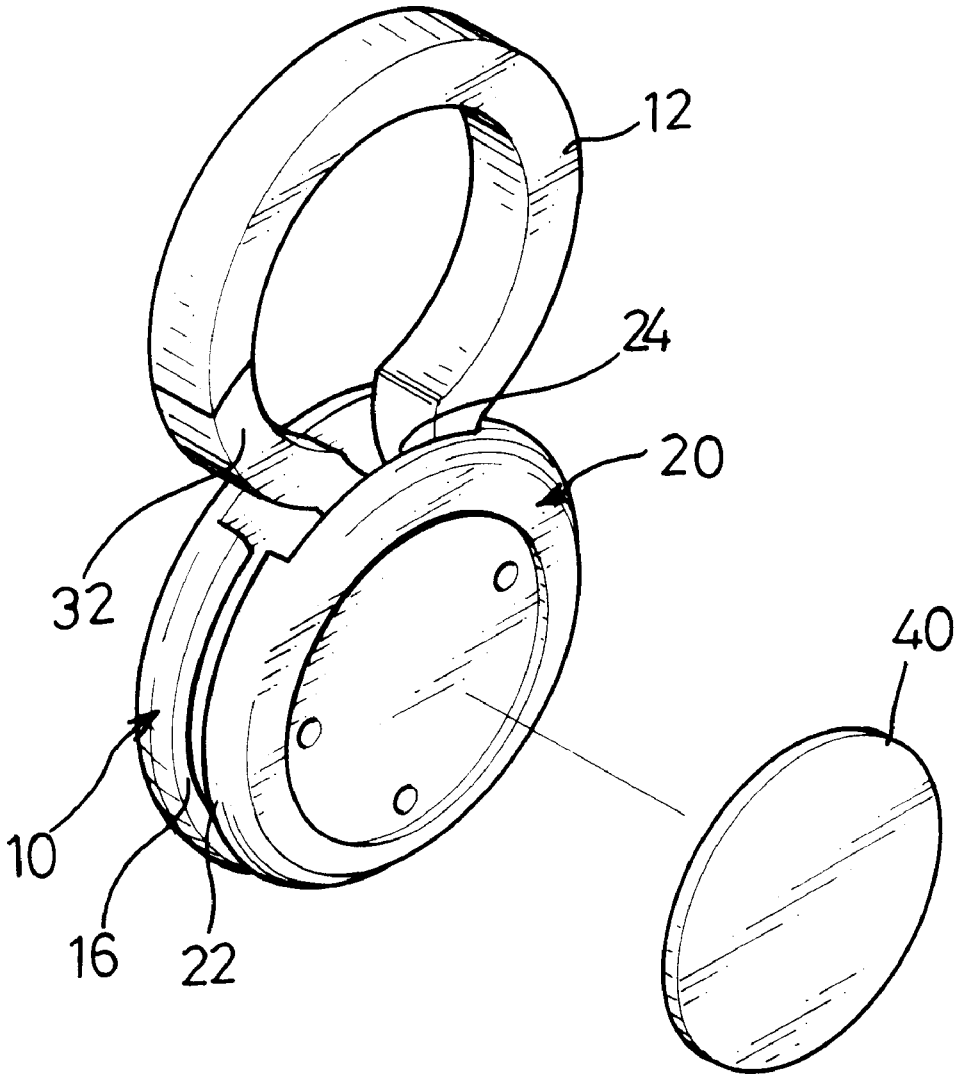
FIG. 4 is a perspective view of the key ring assembly of the invention.
Figure 5:
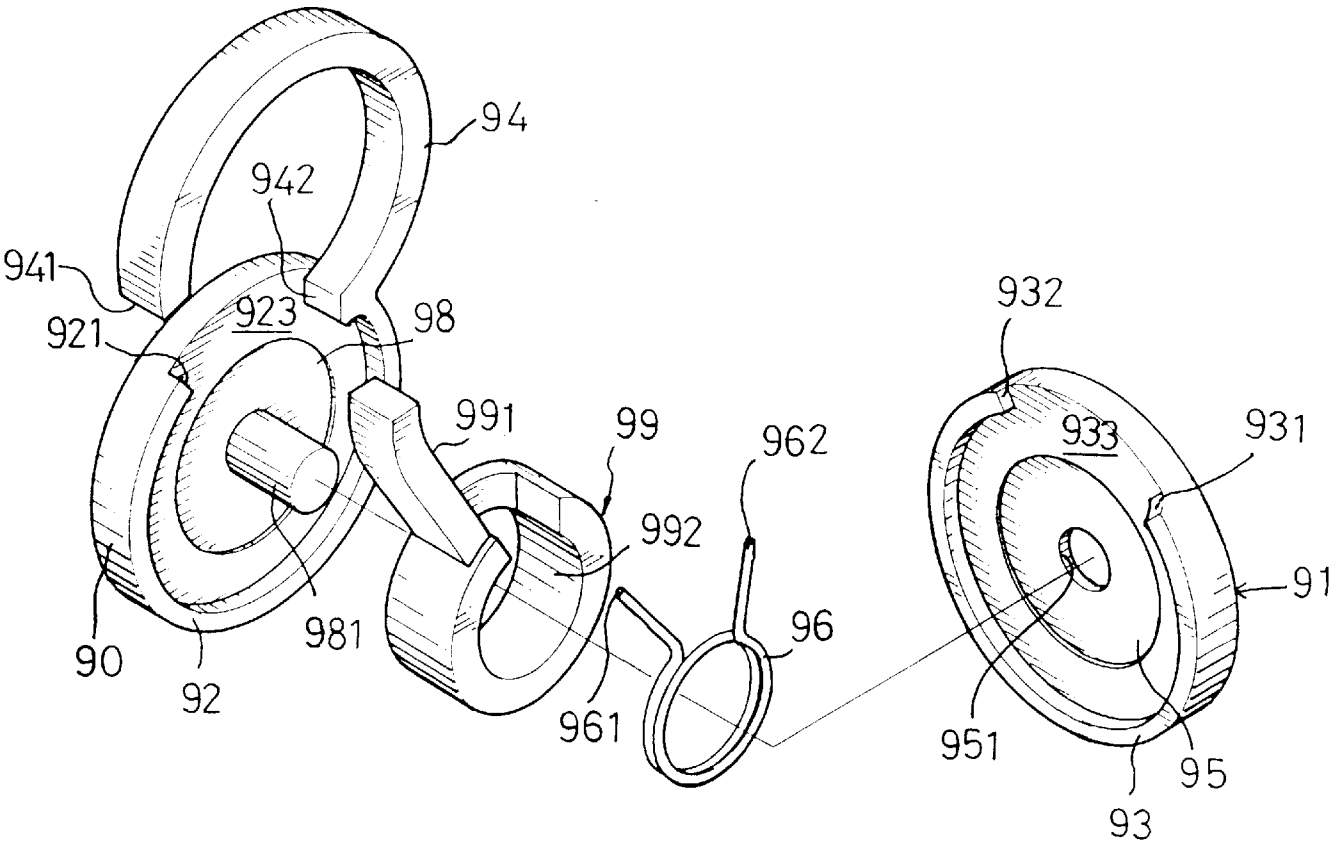
FIG. 5 PRIOR ART
FIG. 5 is an exploded perspective view of a conventional key ring assembly.
Figure 6:
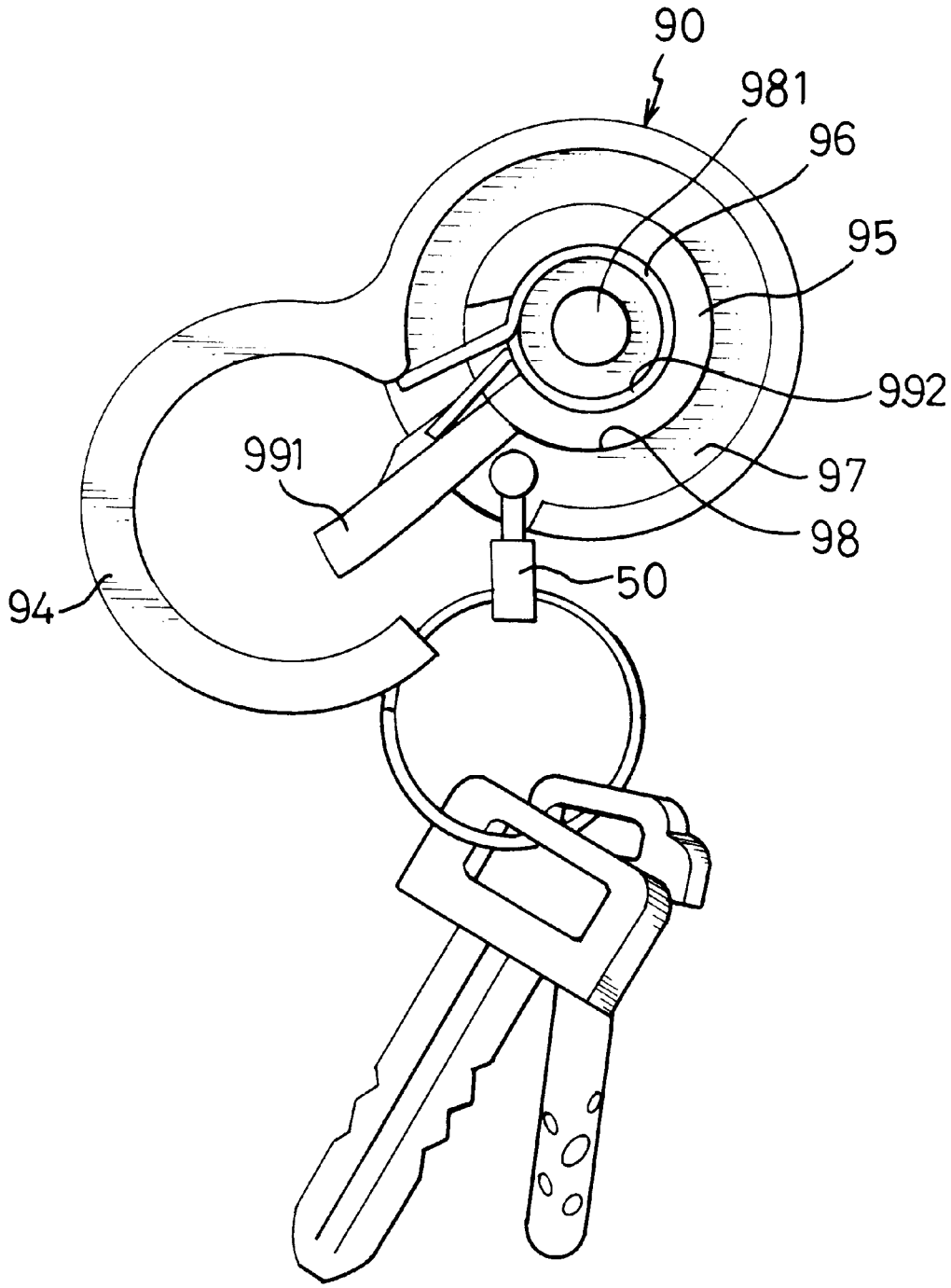
FIG. 6 PRIOR ART
FIG. 6 is a schematic view showing that the load on the fastener may cause the keys together with the fastener to leave the confinement of the loop formed by the conventional retaining arm and the hook member.

When taking FIG. 4 for reference, it is to be noted that a decorative sticker (40) is able to be attached to the outer face of the first and second half bodies (10, 20) to increase the attraction of the key ring assembly.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed. It should also be noted that those skilled in the art are able to make amendment, alterations and changes according to the detailed description of the preferred embodiment. However, those alternations, changes and\or amendments should also be included in the principle of the invention and claimed in the appended claims.

What is claimed is:

1. A key ring assembly comprising a first half body having a first flange portion which is laterally formed along a periphery thereof and projects outwardly therefrom and comprises a first distal end and a second distal end, a hook member having a first end portion located above said first distal end of said first flange portion and a second end portion formed on said second distal end of said first flange portion, and a first opening defined between said first distal end of said first flange portion and said second end portion of said hook member;

a second half body coupled to said first half body and having a second flange portion which is laterally formed along a periphery thereof and projects therefrom facing towards said first flange portion and comprises a first free end and a second free end, a sliding groove defined between said first and second flange portions, and a second opening defined between said first and second free ends of said second flange portion and communicating with said first opening;

a pivot member pivotally mounted between said first and second half bodies, a retaining arm formed on said pivot member and abutting against said first distal end of said first flange portion and said first free end of said second flange portion and in alignment with said first end portion of said hook member to form a loop, said retaining arm being able to pivot with said pivot member to slide in said first and second openings; and a biasing member mounted between said first and second half bodies and comprising a first pressing end abutting against said retaining arm, wherein the improvements comprising:

an arcuate rib is formed on the first half body and a first end thereof engages with the second end portion of the hook member and has a plurality of spaced grooves defined along a face of the first end and a trough defined in a face of a second free end thereof;

a second pressing end of the biasing member which is received in the pivot member engages in one of the grooves;

the pivot member has a channel defined therein and communicating with the trough of the arcuate rib;

a retainer is securely and movably received in the channel and the trough and selectively extends into the sliding groove between the first half and the second half bodies.

2. The key ring assembly in accordance with claim 1, wherein the pivot member has a compartment defined in such a manner that the biasing member is able to be received therein and a second pressing end of the biasing member extends outward therefrom and into one of the grooves.

3. The key ring assembly in accordance with claim 1, wherein the arcuate rib has a plurality of pins formed thereon and the second half body has a plurality of holes each defined to correspond to one of the pins, so that the first half and the second half bodies are able to connect together in a riveted manner.

4. The key ring assembly in accordance with claim 1, wherein the channel is sectorial.

* * * * *